US009222451B2

(12) United States Patent
Salcedo et al.

(10) Patent No.: US 9,222,451 B2
(45) Date of Patent: Dec. 29, 2015

(54) INJECTION VALVE COMPRISING A TRANSMISSION UNIT

(75) Inventors: Sven Jaime Salcedo, Ebersberg (DE); Michael Knoller, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 878 days.

(21) Appl. No.: 13/377,240

(22) PCT Filed: Jun. 10, 2010

(86) PCT No.: PCT/EP2010/058158
§ 371 (c)(1),
(2), (4) Date: Mar. 7, 2012

(87) PCT Pub. No.: WO2010/142767
PCT Pub. Date: Dec. 16, 2010

(65) Prior Publication Data

US 2012/0160214 A1 Jun. 28, 2012

(30) Foreign Application Priority Data

Jun. 10, 2009 (DE) ..... 10 2009 024 596

(51) Int. Cl.
*F02M 47/02* (2006.01)
*F02M 51/06* (2006.01)

(52) U.S. Cl.
CPC ..... *F02M 51/0603* (2013.01); *F02M 47/027* (2013.01); *F02M 2200/70* (2013.01); *F02M 2200/704* (2013.01)

(58) Field of Classification Search
CPC ... F02M 51/0675; F02M 51/06; F02M 61/00; F02M 51/066; F02M 51/0685; F02M 51/0603; F02M 2200/0704
USPC ..... 239/88, 89, 92, 585.5, 102.1, 239/533.2–533.5, 533.8, 533.9, 533.15, 239/584; 123/446, 294, 467, 472
See application file for complete search history.

(56) References Cited

U.S. PATENT DOCUMENTS 5,033,442 A * 7/1991 Perr ..... F02M 57/021 123/446
6,298,829 B1 10/2001 Welch et al. ..... 123/467
(Continued)

FOREIGN PATENT DOCUMENTS

DE 10326914 A1 1/2005 ..... F02M 51/06
DE 10353045 A1 6/2005 ..... F02M 51/06
(Continued)

OTHER PUBLICATIONS

International PCT Search Report and Written Opinion, PCT/EP2010/058158, 14 pages, Jul. 14, 2010.
(Continued)

*Primary Examiner* — Stephen K Cronin
*Assistant Examiner* — Brian Kirby
(74) *Attorney, Agent, or Firm* — Slayden Grubert Beard PLLC

(57) ABSTRACT

An injection valve for injecting fuel into an internal combustion engine may include an actuator and an injection needle associated with a sealing seat. A hydraulic transmission unit may establish an effective connection between the actuator and the injection needle. The transmission unit may include two movable pistons, between which a movable pot is arranged. The movable pot may be guided within another stationary pot. The first piston may be guided through the bottom of the other pot, and the second piston is guided within a sleeve section of the pot. A first chamber may be formed between the other pot and pot, and a second chamber may be formed between pot and the second piston. The two chambers may be interconnected via at least one duct. One piston may be effectively connected to the injection needle, while the other piston may be effectively connected to the actuator.

22 Claims, 3 Drawing Sheets

(56) References Cited

U.S. PATENT DOCUMENTS

| | | | | |
|---|---|---|---|---|
| 6,390,385 | B1 * | 5/2002 | Hardy et al. | 239/102.2 |
| 6,575,138 | B2 | 6/2003 | Welch et al. | 123/467 |
| 6,679,440 | B2 * | 1/2004 | Igashira | F02M 47/027 239/533.2 |
| 6,685,105 | B1 * | 2/2004 | Ruehle | F02M 51/0603 239/102.1 |
| 6,749,126 | B1 | 6/2004 | Ruehle | 239/4 |
| 6,840,466 | B2 * | 1/2005 | Igashira | F02M 47/027 239/102.1 |
| 7,290,530 | B2 * | 11/2007 | Boecking | F02M 47/207 123/467 |
| 7,419,103 | B2 * | 9/2008 | Pauer | F02M 51/0603 239/102.2 |
| 7,455,244 | B2 * | 11/2008 | Boecking | F02M 51/0603 239/102.2 |
| 7,484,673 | B2 * | 2/2009 | Boecking | F02M 45/04 239/102.1 |
| 7,644,874 | B2 * | 1/2010 | Mochizuki | F02M 51/0603 123/498 |
| 7,644,875 | B2 * | 1/2010 | Mochizuki | F02M 51/0603 123/470 |
| 7,673,811 | B2 * | 3/2010 | Schuster et al. | 239/102.2 |
| 7,699,242 | B2 * | 4/2010 | Mochizuki | F02M 51/0603 239/102.2 |
| 7,770,823 | B2 * | 8/2010 | Kubota | F02M 51/0675 239/533.12 |
| 7,789,322 | B2 * | 9/2010 | Yamamoto | F02M 51/0603 239/102.1 |
| 7,931,211 | B2 * | 4/2011 | Yamamoto | F02M 61/12 239/102.2 |
| 8,418,941 | B2 * | 4/2013 | Melzer | F02M 47/027 239/533.1 |
| 2006/0012265 | A1 | 1/2006 | Bachmaier et al. | 310/316.01 |
| 2006/0016916 | A1 | 1/2006 | Petrone et al. | 239/533.2 |
| 2006/0151637 | A1 | 7/2006 | Schneider et al. | 239/533.2 |
| 2006/0175436 | A1 * | 8/2006 | Boecking | F02M 47/027 239/533.2 |
| 2007/0023542 | A1 * | 2/2007 | Stoecklein | 239/88 |
| 2007/0152080 | A1 | 7/2007 | Boecking | 239/102.2 |
| 2008/0093482 | A1 * | 4/2008 | Boecking | F02M 45/04 239/585.5 |
| 2008/0217440 | A1 * | 9/2008 | Mochizuki et al. | F02M 51/0603 239/585.5 |
| 2008/0217441 | A1 * | 9/2008 | Mochizuki et al. | F02M 51/0603 239/585.5 |
| 2008/0223959 | A1 * | 9/2008 | Kurz | F02M 47/027 239/533.5 |
| 2008/0296414 | A1 * | 12/2008 | Kubota et al. | F02M 51/0675 239/533.11 |
| 2009/0200406 | A1 * | 8/2009 | Kronberger | F02M 51/0603 239/585.5 |
| 2009/0266921 | A1 * | 10/2009 | Boecking | 239/585.5 |

FOREIGN PATENT DOCUMENTS

| | | | | |
|---|---|---|---|---|
| DE | 102004035313 | A1 | 2/2006 | F02M 47/00 |
| DE | 102005004738 | A1 | 8/2006 | F02M 51/06 |
| DE | 102005015731 | A1 | 10/2006 | F02M 51/06 |
| DE | 102005042786 | A1 | 3/2007 | F02M 51/06 |
| DE | 102006027327 | A1 | 12/2007 | F02M 51/06 |
| DE | 102007003216 | A1 | 7/2008 | F02M 51/06 |
| DE | 102008000985 | A1 | 10/2008 | F02M 51/06 |
| WO | 2005/010341 | A1 | 2/2005 | F02M 47/02 |
| WO | 2008/003347 | A1 | 1/2008 | F02M 51/06 |

OTHER PUBLICATIONS

International PCT Search Report and Written Opinion, PCT/EP2010/058132, 15 pages, Aug. 4, 2010.

U.S. Non-Final Office Action, U.S. Appl. No. 13/377,197, 6 pages, Mar. 13, 2014.

* cited by examiner

INJECTION VALVE COMPRISING A TRANSMISSION UNIT

CROSS-REFERENCE TO RELATED APPLICATIONS

This application is a U.S. National Stage Application of International Application No. PCT/EP2010/058158 filed Jun. 10, 2010, which designates the United States of America, and claims priority to German Application No. 10 2009 024 596.0 filed Jun. 10, 2009, the contents of which are hereby incorporated by reference in their entirety.

TECHNICAL FIELD

The invention relates to an injection valve, e.g., a transmission unit of a fuel injection valve.

BACKGROUND

In the prior art, for example WO 2008/003347 A1, U.S. Pat. No. 6,575,138 B2 and U.S. Pat. No. 6,298,829 discloses injection valves in which a hydraulic transmission unit is provided between an actuator and the nozzle needle.

In the known prior art, the deflection of the actuator is transmitted into a corresponding deflection of the nozzle needle.

SUMMARY

In an embodiment, an injection valve for injecting fuel into an internal combustion engine may include an actuator, including a nozzle needle which is assigned to a sealing seat, wherein a transmission unit is provided which establishes an operative connection between the actuator and the nozzle needle, characterized in that the transmission unit has two movable pistons, wherein a movable pot is arranged between the two pistons, wherein the movable pot is guided in a sleeve-shaped section of a further, fixed pot, wherein the first piston is guided through an opening in the bottom of the further pot with a third sealing gap, wherein the second piston projects into a sleeve-shaped section of the pot with a fourth sealing gap, wherein a first chamber is formed between the further pot and the pot, wherein a second chamber is formed between the pot and the second piston, wherein the two chambers are connected to one another via at least one duct, and wherein one piston is operatively connected to the nozzle needle, and the other piston is operatively connected to the actuator.

In a further embodiment, a spring element, which prestresses the movable pot in the direction of the first piston, is clamped in between the nozzle needle and the movable pot. In a further embodiment, the first piston rests on an upper side of a bottom of the movable pot. In a further embodiment, two ducts are provided which connect the two chambers, wherein the two ducts are formed in a bottom of the movable pot. In a further embodiment, the second piston bounds the second chamber with a second end face, wherein the further pot bounds the first chamber with a second annular face which surrounds the first piston, and wherein the second end face is smaller than the second annular face. In a further embodiment, the fixed pot is connected to the housing via a disk-shaped edge region, wherein a drilled hole is formed in the edge region, which drilled hole connects an upper interior space of the injection valve to a lower interior space of the injection valve.

BRIEF DESCRIPTION OF THE DRAWINGS

Example embodiments will be explained in more detail below with reference to figures, in which.

DETAILED DESCRIPTION

Certain embodiments provide an improved transmission unit for an injection valve.

In some embodiments, the transmission unit has two movable pistons, wherein a movable pot is arranged between the two pistons, wherein the movable pot is guided in a further fixed pot, wherein the first piston is guided through a bottom of the further pot with a first sealing gap, wherein the second piston is guided in a sleeve section of the pot with a second sealing gap, wherein a first chamber is formed between the further pot and the pot, wherein a second chamber is formed between the pot and the second piston, wherein the two chambers are connected to one another via at least one duct, and wherein one piston is operatively connected to the nozzle needle, and the other piston is operatively connected to the actuator. According to such embodiments, a transmission unit may reliably permit the deflection of the actuator to be transmitted to the nozzle needle.

In one embodiment, a spring element, which prestresses the movable pot in the direction of the first piston, is clamped in between the nozzle needle and the movable pot. Prestress of the nozzle needle in the direction of a sealing seat may therefore be made possible.

In a further embodiment, the first piston rests on an outer side of the bottom of the movable pot. Idle travel may therefore be set precisely.

In a further embodiment, two ducts are provided which connect the two chambers, wherein the two ducts are formed in the bottom of the movable pot. The formation of two ducts may permit rapid pressure equalization between the two chambers.

In a further embodiment, the second piston bounds the second chamber in a second end face, wherein the further pot bounds the first chamber with a second annular face which surrounds the first piston. The second end face of the second piston may be smaller than the second annular face of the further pot. In this way, transmission of the deflection of the actuator into a relatively large deflection of the nozzle needle may be made possible. As a result, small deflections, for example of a piezo-electric actuator, may be converted into relatively large deflections of the nozzle needle.

Figure 1:
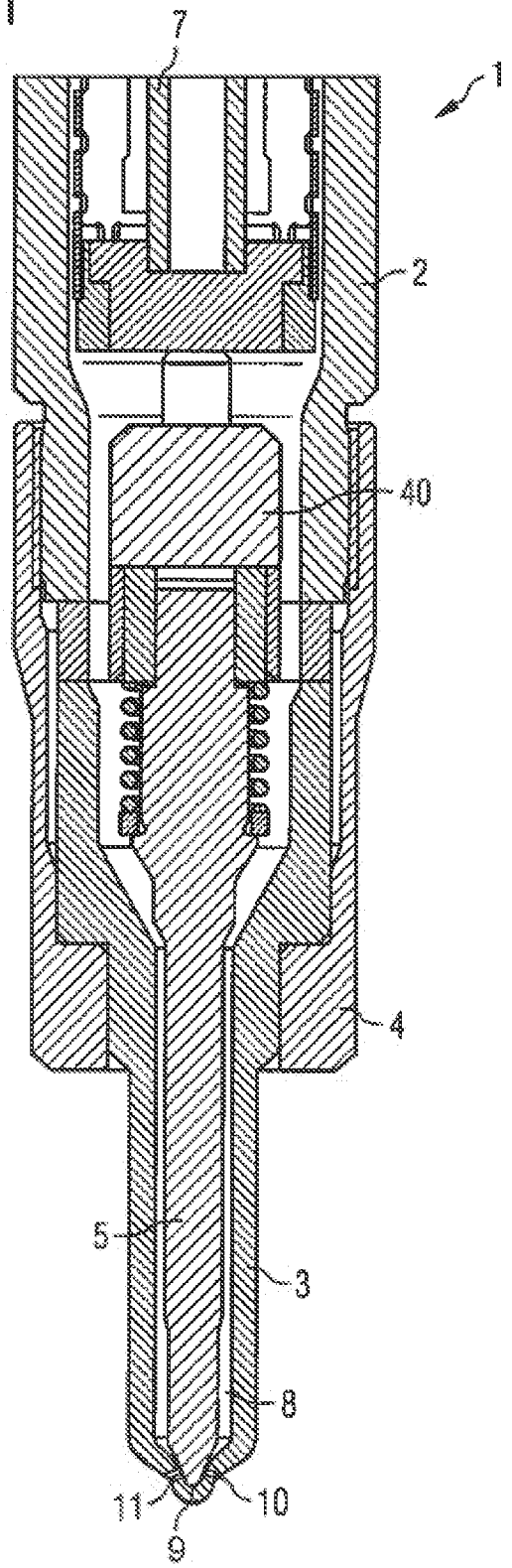
FIG. 1 shows a schematic design of an injection valve, according to certain embodiments.

FIG. 1 is a schematic illustration of an example injection valve 1, according to certain embodiments. The example injection valve 1 has a housing 2 to whose lower end a nozzle body 3 is attached using a clamping nut 4. A nozzle needle 5 is mounted so as to be movable in the longitudinal direction in the nozzle body 3. The nozzle needle 5 is operatively connected to an actuator 7 via a transmission unit 40. A fuel space 8, which is supplied with fuel via ducts (not illustrated), for example via a fuel accumulator and/or via a fuel pump, is formed in the lower region of the nozzle body 2, between the nozzle needle 5 and the nozzle body 3. An annular sealing seat 10 is formed on the inside of the nozzle body 3, between the fuel space 8 and injection holes 9. A sealing face 11 which runs around in an annular shape at the lower end of the nozzle needle 5 is assigned to the sealing seat 10. Depending on the position of the nozzle needle, which is set by the activation of the actuator 7, the nozzle needle 5 lifts off from the sealing seat 10 and clears a hydraulic connection between the fuel space 8 and the injection holes 9.

The actuator 7 can be embodied, for example, as a piezoelectric actuator or as a magnetic actuator. Through electrical energization of the actuator 7, the actuator 7 becomes longer and therefore acts on the transmission unit 40. The transmission unit 40 is embodied in such a way that the deflection of the actuator 7 is transmitted to the nozzle needle 5. The deflection of the actuator 7 in the direction of the nozzle needle 5 may be converted into an opposing movement of the nozzle needle 5 in the direction of the actuator 7 by means of the transmission unit 40.

Figure 2:
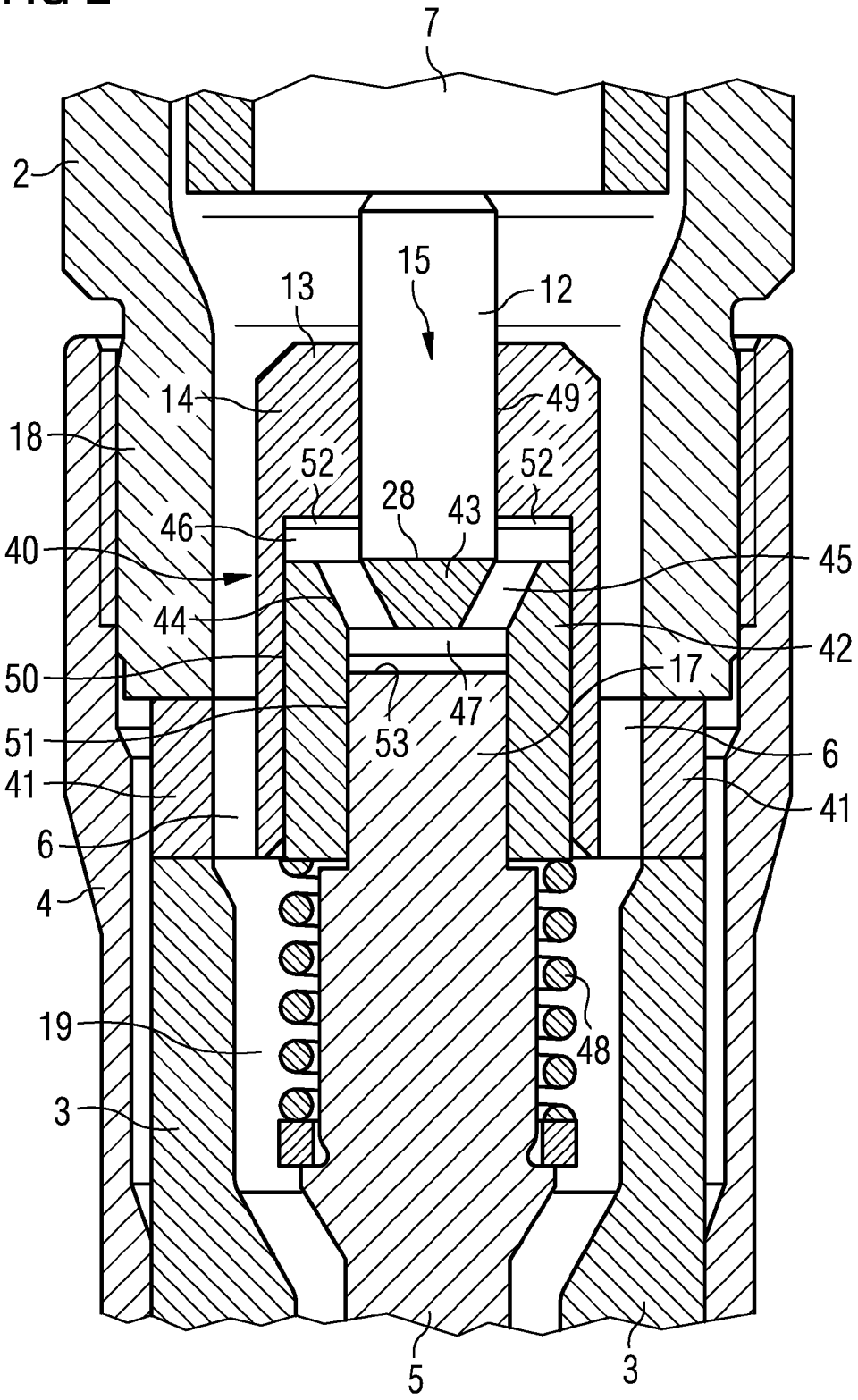
FIG. 2 shows a transmission unit, according to certain embodiments.

FIG. 2 shows an enlarged illustration of the example transmission unit 40, according to certain embodiments. In the transmission unit 40, a cylindrical first piston 12 projects through an opening 15 in a bottom 13 of a pot 14. The pot 14 is fixedly connected to the housing 2 by means of an edge region 41 which runs round in a disk shape. Drilled holes 6 are formed in the edge region 41, through which drilled holes 6 fuel can flow from an upper interior space of the injection valve to a lower interior space of the injection valve. A second sleeve-shaped pot 42 is arranged in the pot 14, said pot 42 being movably mounted in a sleeve-shaped section of the pot 14. A cylindrical end piece 17 of the nozzle needle 5 is guided into the sleeve-shaped section of the second pot 42.

The end piece 17 constitutes a piston. The first piston 12 rests with the end face 28 on an upper side of a second bottom 43 of the second pot 42. Two ducts 44, 45 are formed in the second bottom 43. A first chamber 46 is formed between the first and the second pots 14, 42 and the first piston 12. A second chamber 47 is formed between the second pot 42 and the end piece 17.

The first pot 14 bounds the first chamber 46 with a second annular face 52 which is formed on an inner side of the bottom 13. The end piece 17 bounds the second chamber 47 with a second end face 53. The second end face 53 may be smaller than the second annular face 52. In particular, the second end face 53 is half as large as the second annular face. The surface area ratio between the second end face 53 and the second annular face defines a transmission between the deflection of the actuator and the deflection of the nozzle needle. A third spring element 48 is clamped between the second pot 42 and the nozzle needle 5. The first and second ducts 44, 45 connect the first and second chambers 46, 47. The first piston 12 is guided in a seal-forming fashion via a third sealing gap 49 in the bottom 13. The second pot 42 is guided in a seal-forming fashion in a sleeve-shaped section of the fixed pot 14 via a fourth sealing gap 50. The end piece 17 is guided in a seal-forming fashion in the sleeve-shaped section of the second pot 42 via a fifth sealing gap 51. The third, fourth and fifth sealing gaps 49, 50, 51 may have a width of 2 to 20 μm, in particular in the region of 8 μm. The third, fourth and fifth sealing gaps 49, 50, 51 are dimensioned in such a way that the first and second chambers which are filled with fuel are sealed with respect to the interior space of the injection valve when there is a brief application of pressure, which occurs during injection processes. The third, fourth and fifth sealing gaps 49, 50, 51 ensure that the first and second chambers 46, 47 are always filled with fuel and that pressure differences which are present over relatively long time periods, i.e. for longer than injection processes, are equalized.

The transmission unit 40 functions as follows: in the non-actuated state of the actuator 7 the nozzle needle 5 is seated with the sealing face 11 on the sealing seat 10, with the result that there is no connection between the fuel space 8 and the injection holes 9. There is therefore no injection of fuel. The actuator 7 rests here on the first piston 12. The first piston 12 rests on the second bottom 43 of the second movable pot 42 and therefore presses the nozzle needle 5 into the sealing seat via the third spring element 48. The first and second chambers 46, 47 are completely filled with fuel, wherein the housing 2 in the region of the transmission unit 40 is also filled with fuel.

If an injection is then carried out, the actuator 7 is energized, with the result that the actuator moves downward in the direction of the transmission unit 40. For this purpose, the actuator 7 is supported in the upper region against the housing 2 of the injection valve. The movement of the actuator 7 pushes the first piston 12 downward. The first piston 12 pushes the second pot 42 downward. The pressure in the second chamber 47 is therefore increased, with the result that fuel flows out of the second chamber 47 into the first chamber 46 via the first and second ducts 44, 45. As a result the pressure in the second chamber 47 drops, with the result that the nozzle needle 5 moves upward and lifts off from the sealing seat 10. Consequently, the injection starts.

If the injection is to be ended, the actuator 7 is actuated in such a way that it becomes shorter. As a result of this, the force acting on the first piston 12 and therefore also acting on the second pot 42 decreases. Consequently, the pressure in the second chamber 47 drops. In addition, the third spring element 48 causes the nozzle needle 5 to be pulled out of the second sleeve 42. As a result, fuel flows back from the first chamber into the second chamber, and the nozzle needle 5 is pressed downward onto the sealing seat.

Figure 3:
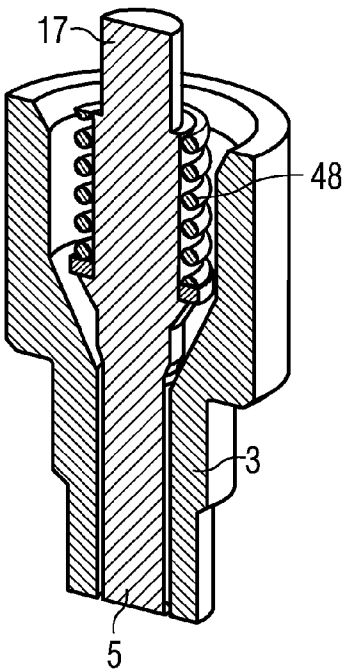
FIG. 3 shows a nozzle body with a nozzle needle, according to certain embodiments.

FIG. 3 shows a schematic illustration of the nozzle body 3 with the end piece 17 of the nozzle needle 5 and the third spring element 48 which rests on a step on the nozzle needle 5, according to certain embodiments.

Figure 4:
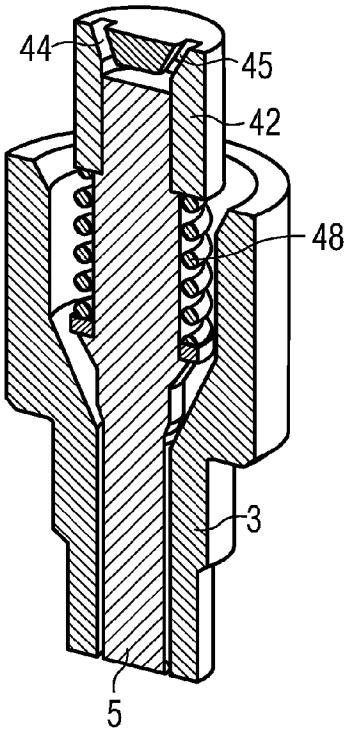
FIG. 4 shows a nozzle needle with a second pot, according to certain embodiments.
Figure 5:
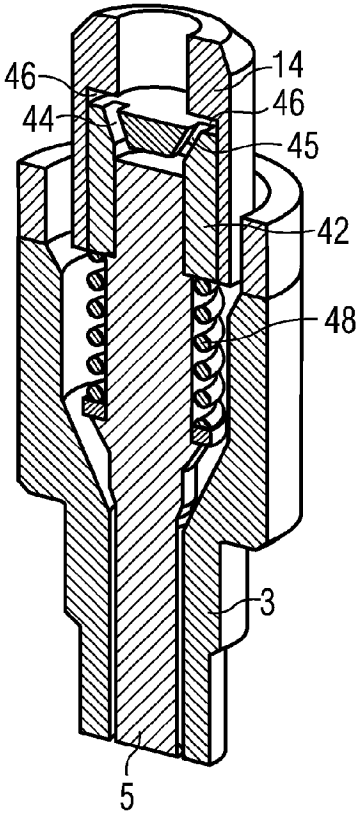
FIG. 5 shows a nozzle needle with a fixed pot, according to certain embodiments.
Figure 6:
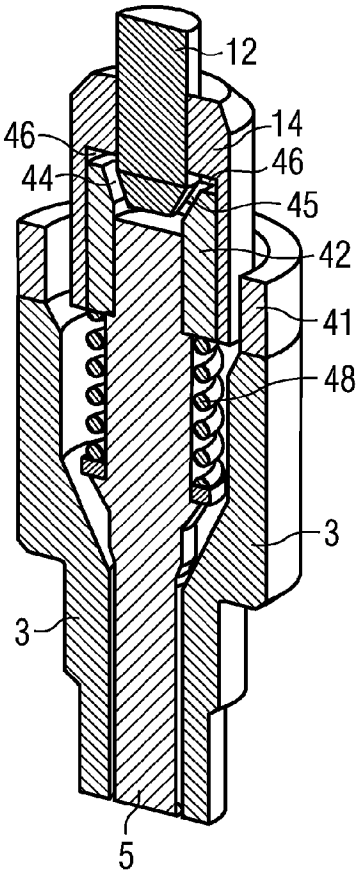
FIG. 6 shows a nozzle needle with a transmission piston, according to certain embodiments.

FIG. 4 shows a cross section through the second sleeve 42 which is fitted onto the end piece 17 of the nozzle needle, according to certain embodiments. The sleeve 14 is then fitted over the second sleeve 42, as is illustrated in FIG. 5. The piston 12 is then pushed in through the opening in the bottom 13, as is illustrated in FIG. 6. The actuator 7 is then mounted in the housing, and the structural unit as shown in FIG. 1 is clamped to the housing 2 by means of the clamping nut 4. The upper and lower interior spaces 18, 19 of the injection valve 1 are filled with fuel.

What is claimed is:

1. An injection valve for injecting fuel into an internal combustion engine, comprising:

an injection valve housing, an actuator arranged in the injection valve housing, a nozzle needle associated with a sealing seat and configured for an injection process in which the nozzle needle lifts off of the sealing seat to allow a fuel injection and then returns to the sealing seat, and a transmission unit that establishes an operative connection between the actuator and the nozzle needle, the transmission unit including:

first and second movable pistons, and a movable first pot arranged between the two pistons, wherein the movable first pot is guided in a sleeve-shaped section of a fixed second pot, the fixed second pot being fixedly coupled to, and thus remaining stationary relative to, the injection valve housing throughout the injection process, wherein the first piston is guided through an opening in the fixed second pot with a sealing gap defined between the first piston and the opening in the fixed second pot, wherein the second piston projects into a sleeve-shaped section of the movable first pot with a sealing gap defined between the second piston and the sleeve shaped section of the movable first pot, wherein a first chamber is formed between the movable first pot and the fixed second pot, wherein a second chamber is formed between the fixed second pot and the second piston and downstream of the first chamber along an axial direction from the actuator toward the sealing seat, wherein the first and second chambers are connected to one another via at least one duct, and wherein movement of the first piston toward the nozzle needle decreases a volume of the second chamber and thus increases a pressure in the second chamber, thereby forcing creating a fluid flow from the second chamber to the first chamber in an upstream direction via the at least one duct, wherein one of the first and second pistons is operatively connected to the nozzle needle, and the other one of the first and second pistons is operatively connected to the actuator.

2. The injection valve of claim 1, including a spring element configured to prestress the movable first pot in the direction of the first piston.

3. The injection valve of claim 1, wherein the first piston rests on an upper side of a bottom of the movable first pot.

4. The injection valve of claim 1, including two ducts that connect the first and second chambers, wherein the two ducts are formed in a bottom of the movable first pot.

5. The injection valve of claim 1, wherein the second piston bounds the second chamber with a second end face, wherein the fixed second pot bounds the first chamber with a second annular face which surrounds the first piston, and wherein the second end face is smaller than the second annular face.

6. The injection valve of claim 1, wherein the fixed second pot is connected to the injection valve housing via a disk-shaped edge region, wherein a drilled hole is formed in the edge region, which drilled hole connects an upper interior space of the injection valve to a lower interior space of the injection valve.

7. The injection valve of claim 1, wherein the first chamber is generally ring-shaped and extends around a portion of the first piston.

8. The injection valve of claim 1, wherein a diameter of the first chamber is larger than a diameter of the second piston.

9. The injection valve of claim 1, wherein each duct connecting the first and second chambers extends diagonally with respect to an axial direction of the first and second pistons.

10. The injection valve of claim 4, wherein the two ducts are located on opposite sides of a bottom portion of the movable first pot.

11. An injection valve for injecting fuel into an internal combustion engine, comprising:

an injection valve housing, an actuator arranged in the injection valve housing, a nozzle needle associated with a sealing seat and configured for an injection process in which the nozzle needle lifts off of the sealing seat to allow a fuel injection and then returns to the sealing seat, and a transmission unit that establishes an operative connection between the actuator and the nozzle needle, the transmission unit including:

first and second pistons, and a first pot arranged between the two pistons, wherein the first pot is guided in a sleeve-shaped section of a second pot that is fixedly coupled to, and thus remains stationary relative to, the injection valve housing throughout the injection process, wherein a first chamber is formed between the first pot and the second pot, wherein a second chamber is formed between the second pot and the second piston and downstream of the first chamber along an axial direction from the actuator toward the sealing seat, and wherein the first and second chambers are connected to one another via at least one duct.

12. The injection valve of claim 11, including a spring element configured to prestress the first pot in the direction of the first piston.

13. The injection valve of claim 11, wherein the first piston rests on an upper side of a bottom of the first pot.

14. The injection valve of claim 11, including two ducts that connect the first and second chambers, wherein the two ducts are formed in a bottom of the first pot.

15. The injection valve of claim 11, wherein the second piston bounds the second chamber with a second end face, wherein the second pot bounds the first chamber with a second annular face which surrounds the first piston, and wherein the second end face is smaller than the second annular face.

16. The injection valve of claim 11, wherein the first chamber is generally ring-shaped and extends around a portion of the first piston.

17. The injection valve of claim 11, wherein a diameter of the first chamber is larger than a diameter of the second piston.

18. The injection valve of claim 11, wherein each duct connecting the first and second chambers extends diagonally with respect to an axial direction of the first and second pistons.

19. The injection valve of claim 14, wherein the two ducts are located on opposite sides of a bottom portion of the first pot.

20. An internal combustion engine comprising:

one or more cylinders, and one or more injection valves for injecting fuel into the one or more cylinders, each injection valve comprising:

an injection valve housing, an actuator arranged in the injection valve housing, a nozzle needle associated with a sealing seat and configured for an injection process in which the nozzle needle lifts off of the sealing seat to allow a fuel injection and then returns to the sealing seat, and a transmission unit that establishes an operative connection between the actuator and the nozzle needle, the transmission unit including:

first and second pistons, and a first pot arranged between the two pistons, wherein the first pot is guided in a sleeve-shaped section of a second pot that is fixedly coupled to, and thus remains stationary relative to, the injection valve housing throughout the injection process, wherein a first chamber is formed between the first pot and the second pot, wherein a second chamber is formed between the second pot and the second piston and downstream of the first chamber along an axial direction from the actuator toward the sealing seat, and wherein the first and second chambers are connected to one another via at least one duct.

21. An injection valve for injecting fuel into an internal combustion engine, comprising:

an injection valve housing, an actuator arranged in the injection valve housing, a nozzle needle associated with a sealing seat and configured for an injection process in which the nozzle needle lifts off of a sealing seat to allow a fuel injection and then returns to the sealing seat, and a transmission unit that establishes an operative connection between the actuator and the nozzle needle, the transmission unit including:

first and second movable pistons, and a movable first pot arranged between the two pistons, wherein the movable first pot is guided in a sleeve-shaped section of a fixed second pot, the fixed second pot being fixedly coupled to, and thus remaining stationary relative to, the injection valve housing throughout the injection process, wherein the first piston is guided through an opening in the fixed second pot with a sealing gap defined between the first piston and the opening in the fixed second pot, wherein the second piston projects into a sleeve-shaped section of the movable first pot with a sealing gap defined between the second piston and the sleeve shaped section of the movable first pot, wherein a first chamber is formed between the movable first pot and the fixed second pot, wherein a second chamber is formed between the fixed second pot and the second piston, wherein the first and second chambers are connected to one another via at least one duct, and wherein one of the first and second pistons is operatively connected to the nozzle needle, and the other one of the first and second pistons is operatively connected to the actuator, and a spring element configured to prestress the movable first pot in the direction of the first piston.

22. An injection valve for injecting fuel into an internal combustion engine, comprising:

an injection valve housing, an actuator arranged in the injection valve housing, a nozzle needle associated with a sealing seat and configured for an injection process in which the nozzle needle lifts off of a sealing seat to allow a fuel injection and then returns to the sealing seat, and a transmission unit that establishes an operative connection between the actuator and the nozzle needle, the transmission unit including:

first and second movable pistons, and a movable first pot arranged between the two pistons, wherein the movable first pot is guided in a sleeve-shaped section of a fixed second pot, the fixed second pot being fixedly coupled to, and thus remaining stationary relative to, the injection valve housing throughout the injection process, wherein the first piston is guided through an opening in the fixed second pot with a sealing gap defined between the first piston and the opening in the fixed second pot, wherein the first piston rests on an upper side of a bottom of the movable first pot, wherein the second piston projects into a sleeve-shaped section of the movable first pot with a sealing gap defined between the second piston and the sleeve shaped section of the movable first pot, wherein a first chamber is formed between the movable first pot and the fixed second pot, wherein a second chamber is formed between the fixed second pot and the second piston, wherein the first and second chambers are connected to one another via at least one duct, and wherein one of the first and second pistons is operatively connected to the nozzle needle, and the other one of the first and second pistons is operatively connected to the actuator.

* * * * *